US007323649B2

(12) United States Patent
Chou

(10) Patent No.: US 7,323,649 B2
(45) Date of Patent: Jan. 29, 2008

(54) JERKING-INITIATED SWITCH

(76) Inventor: Tien-Ming Chou, No. 41, San-Hsi 5th St., Taichung City (TW)

( * ) Notice: Subject to any disclaimer, the term of this patent is extended or adjusted under 35 U.S.C. 154(b) by 95 days.

(21) Appl. No.: 11/446,465

(22) Filed: Jun. 2, 2006

(65) Prior Publication Data

US 2007/0278069 A1 Dec. 6, 2007

(51) Int. Cl.
*H01H 3/16* (2006.01)

(52) U.S. Cl. ..... 200/61.45 R; 200/61.52; 73/514.16; 250/231.1

(58) Field of Classification Search ..... 200/61.45 R, 200/61.52, 284; 73/514.01, 514.16; 250/231.01, 250/221, 229

See application file for complete search history.

(56) References Cited

U.S. PATENT DOCUMENTS 5,252,795 A * 10/1993 Su ..... 200/61.52
6,559,396 B1 * 5/2003 Chou ..... 200/61.52
6,706,978 B2 * 3/2004 Wagatsuma et al. .. 200/61.45 R
6,740,867 B2 * 5/2004 Chou ..... 250/231.1

* cited by examiner

*Primary Examiner*—K. Richard Lee
(74) *Attorney, Agent, or Firm*—Frommer Lawrence & Haug LLP; Ronald R. Santucci

(57) ABSTRACT

A jerking-initiated switch includes two first shank members and two second shank members secured to first and second lateral sides of a base wall of an insulating frame to define a rolling path for rolling of an electrically conductive ball therealong. Two limb members are respectively and integrally formed with, and extend from, the second shank members to form a guideway along the rolling path such that the ball can slidably contact the limb members, and extend towards the first shank members to terminate at threshold regions that are spaced apart from the first shank members. The limb members have idle regions on the rolling path. Once the ball is jerked to displace from one of the idle and threshold regions to the other, the switch is placed in one of the first and second switching states.

10 Claims, 18 Drawing Sheets

JERKING-INITIATED SWITCH

BACKGROUND OF THE INVENTION

1. Field of the Invention

This invention relates to a jerking-initiated switch, more particularly to a jerking-initiated switch having an electrically conductive ball rollable within an insulating frame to engage or disengage from two pairs of electric contact terminals.

2. Description of the Related Art

Referring to FIGS. 1 and 2, a conventional jerking-initiated switch 100 is shown to include an insulating housing 101, an electrically conductive ball 102, four contact terminals 103, and a plug 104. In assembly, the ball 102 is received in the housing 101, and an access opening of the housing 101 is closed by the plug 104. Tapered contact ends 1031 of the contact terminals 103 are inserted into the housing 101 through four through holes 1041 in the plug 104 by using a tool (not shown). By contacting the ball 102 with the contact ends 1031 of two of the terminals 103, the electric contact between the terminals 103 can be established. However, since the terminals 103 are mounted on the plug 104 and are disposed in a suspended state, the operation of the tool for assembling the terminals 103 must be precise so as to align the contact ends 1031 with one another. Moreover, as the terminals 103 are not firmly secured in the plug 104, sensitivity of the switch 100 is unsteady.

The switch 100 can be mounted on a substrate 105 in an upright state shown in FIG. 2. The switch 100 can also be mounted under the substrate 105 by bending the terminals 103 such that an included angle (θ) is formed between the housing 101 and the substrate 105. The angle (θ) is liable to be changed by an external force to result in failure of the switch 100.

SUMMARY OF THE INVENTION

The object of the present invention is to provide a jerking-initiated switch which has contact terminals mounted in a steady manner, and which can achieve enhanced sensitivity.

According to this invention, the jerking-initiated switch includes an insulating frame which includes a base wall and first and second upright walls extending respectively from first and second lateral sides of the base wall to define a rolling path between the upright walls. An electrically conductive ball is disposed to be rollable along the rolling path between first and second switching positions where the switch is in first and second switching states, respectively. An interconnecting member is secured to the first lateral side of the base wall, and extends to terminate at front and rear first joining ends. Front and rear first shank members, which are made from an electrically conductive material, are respectively connected to the front and rear first joining ends, and extend to terminate at front and rear first contact terminals, respectively. The front and rear first contact terminals extend outwardly of the frame, and are adapted to be in electric contact with a substrate. Front and rear second shank members, which are made from an electrically conductive material, are respectively secured to the second lateral side of the base wall. The front and rear second shank members extend to terminate at front and rear second contact terminals, respectively, which extend outwardly of the frame and which are adapted to be in electric contact with the substrate. Front and rear limb members are respectively and integrally formed with, and extend respectively from, front and rear second joints of the front and rear second shank members so as to cooperatively form a guideway along the rolling path such that the ball can slidably contact the front and rear limb members, respectively. The front and rear limb members extend towards the front and rear first shank members, respectively, to terminate at front and rear threshold regions, respectively. The front and rear threshold regions are spaced apart from the front and rear first shank members, respectively, and correspond to the first switching position. The front and rear limb members respectively have front and rear idle regions configured to correspond to the second switching position. Therefore, once the ball is caused to displace from one of the idle and threshold regions to the other in response to a jerking action, the switch is placed in one of the first and second switching states.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
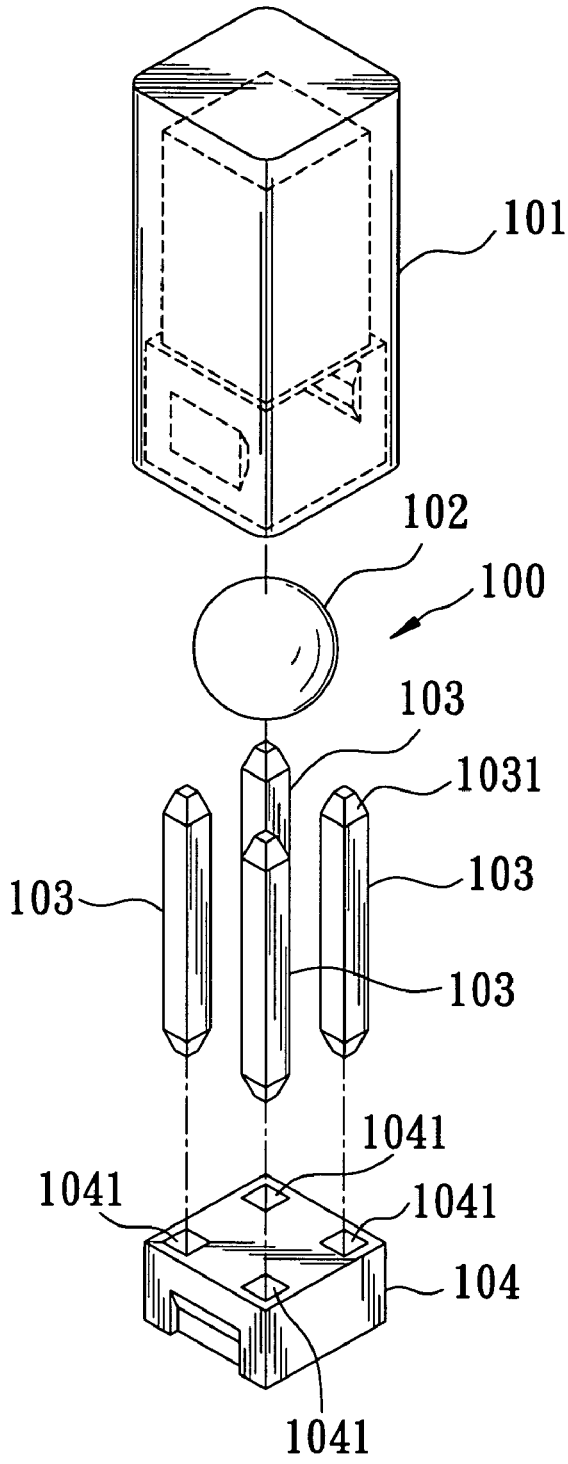
FIG. 1 PRIOR ART
FIG. 1 is an exploded perspective view of a conventional jerking-initiated switch.
Figure 2:
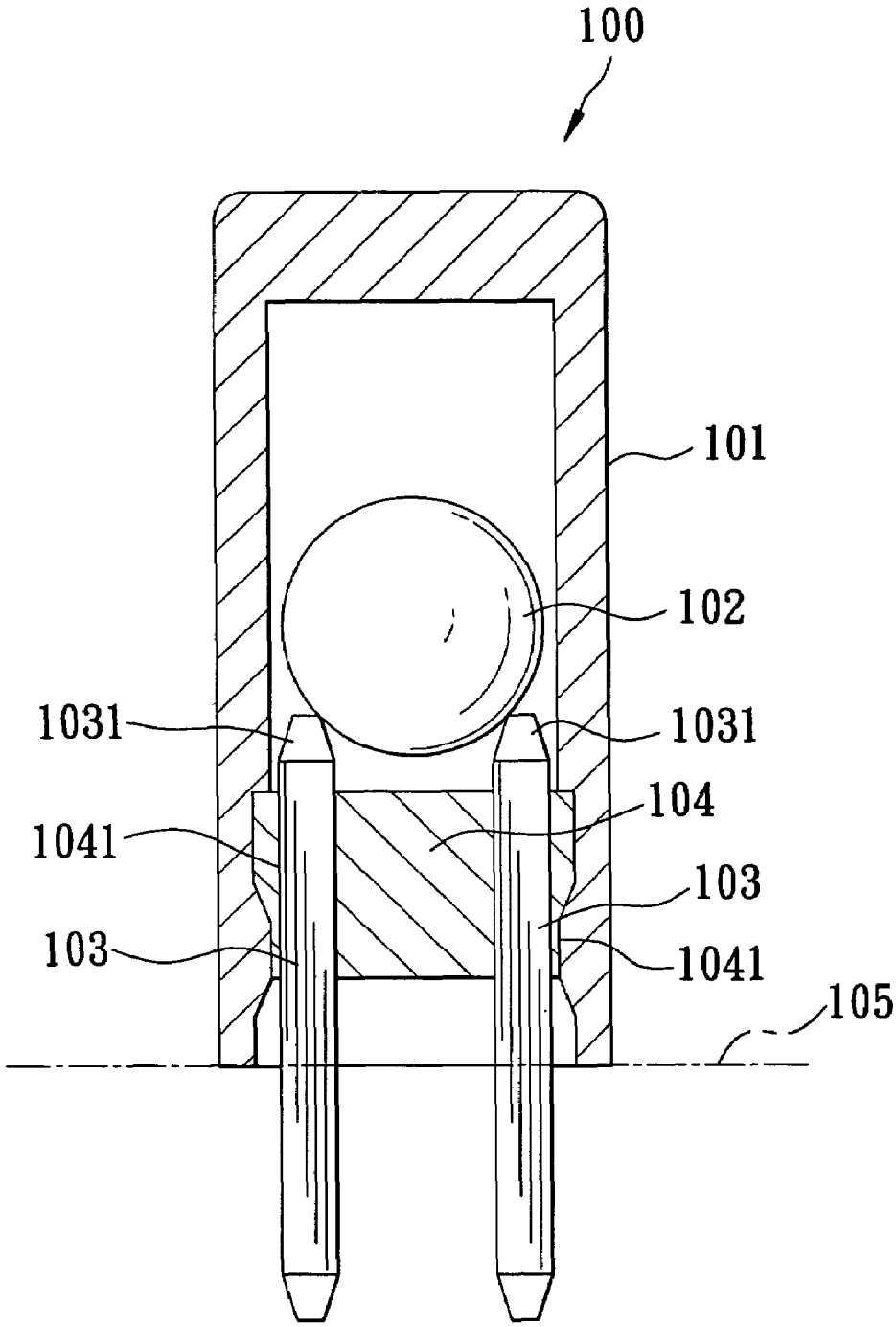
FIG. 2 PRIOR ART
FIG. 2 is a sectional view of the conventional jerking-initiated switch mounted on a substrate.
Figure 3:
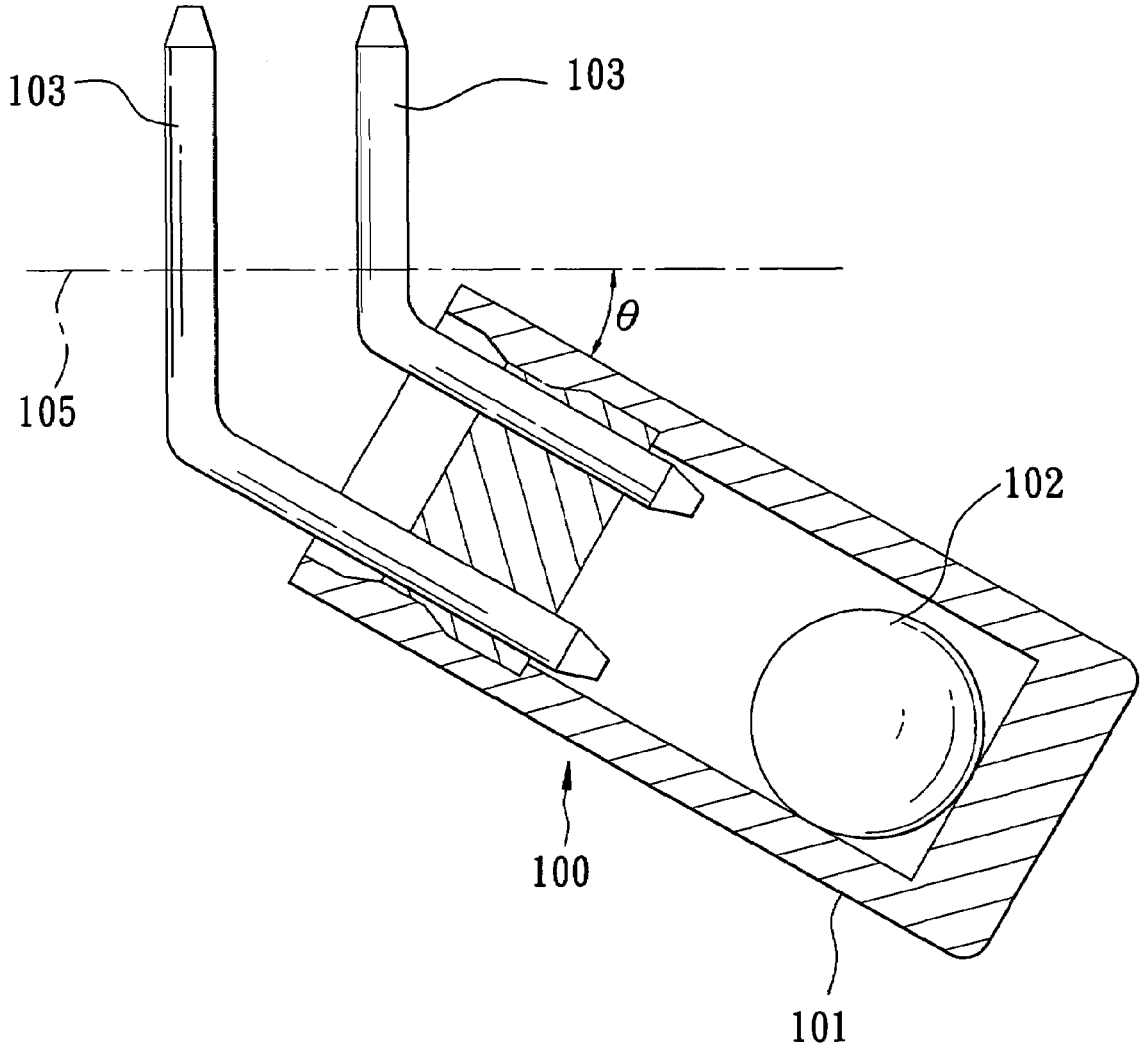
FIG. 3 PRIOR ART
FIG. 3 is a sectional view of the conventional jerking-initiated switch mounted under a substrate.

Before the present invention is described in greater detail, it should be noted that same reference numerals have been used to denote like elements throughout the specification.

Figure 4:
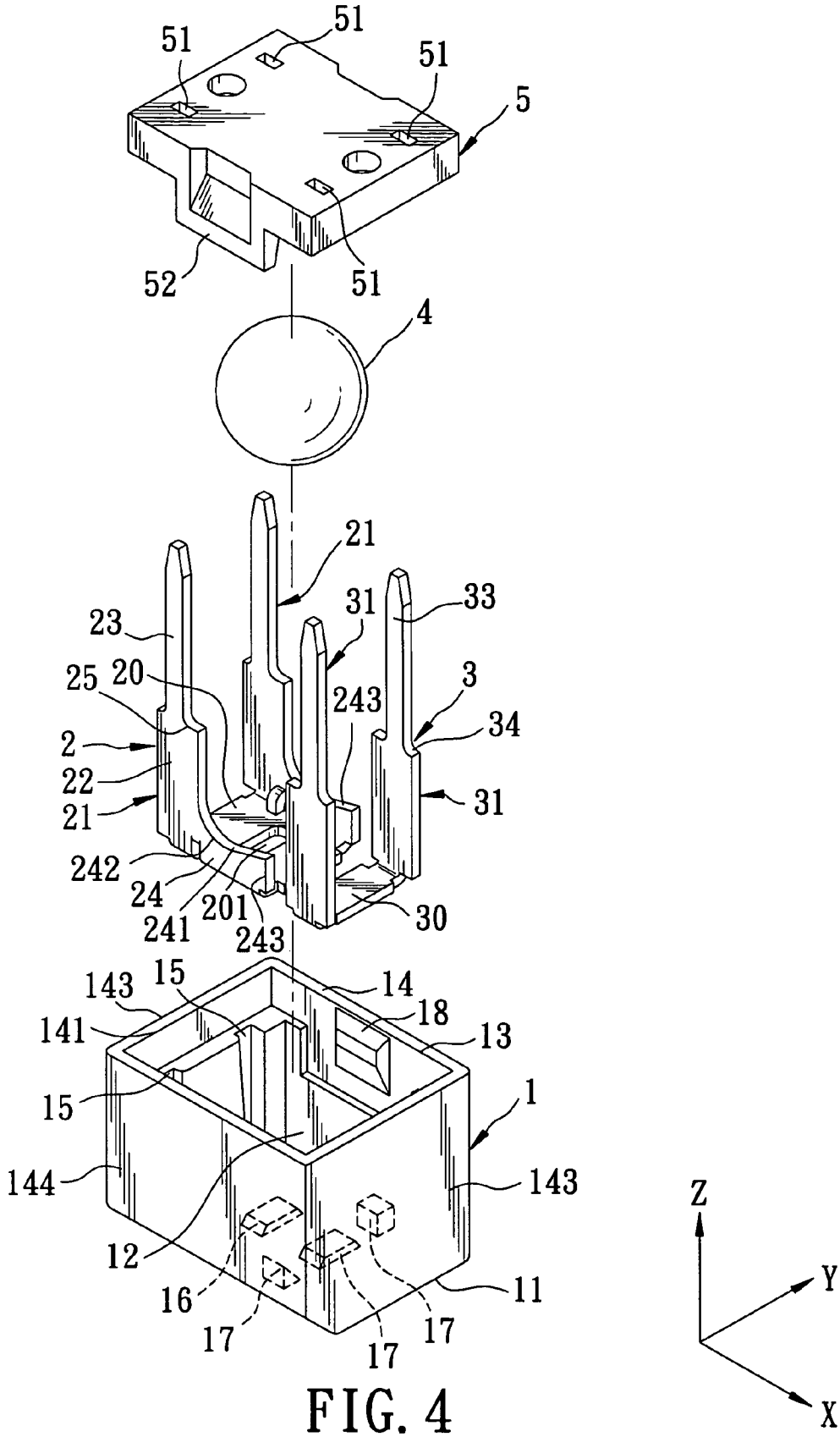
FIG. 4 is an exploded perspective view of the first preferred embodiment of a jerking-initiated switch according to this invention.
Figure 5:
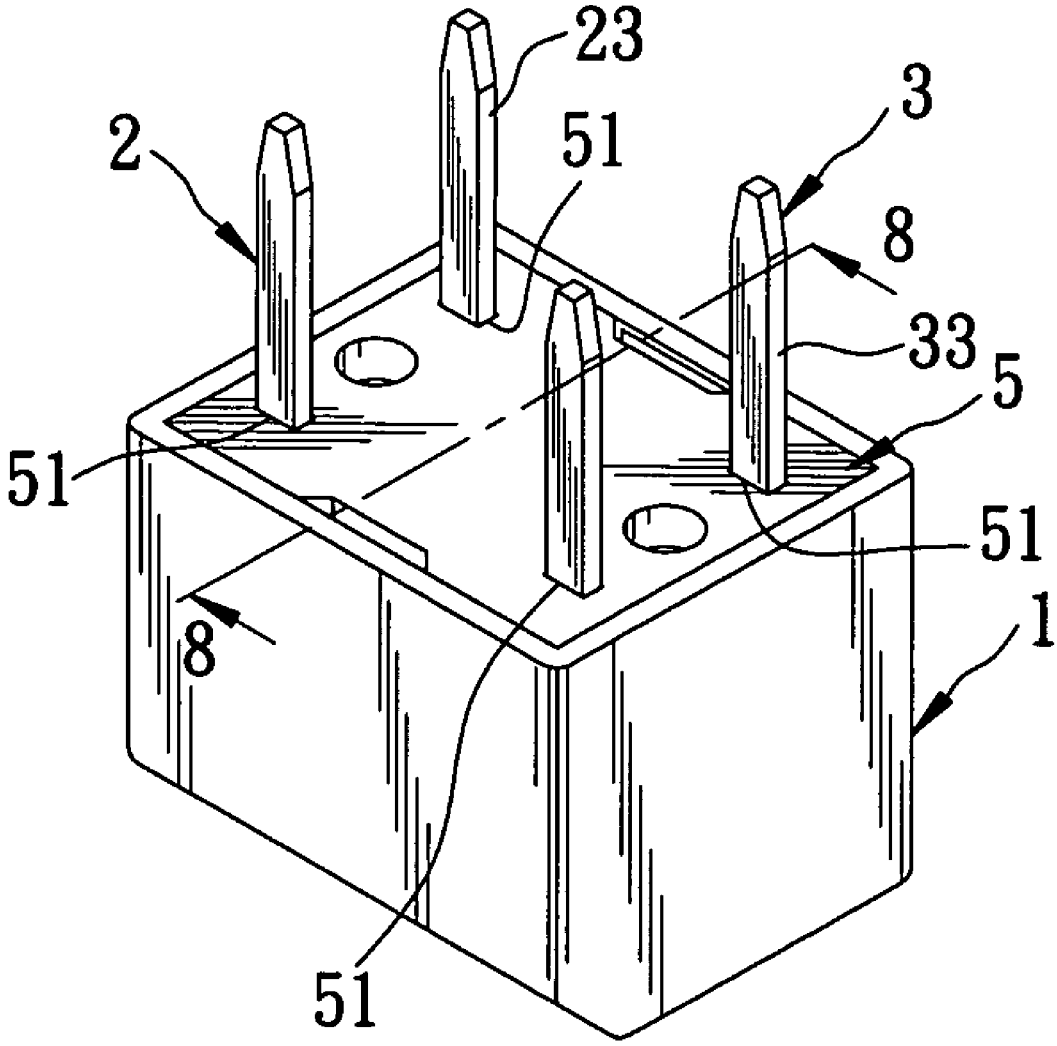
FIG. 5 is a perspective view of the first preferred embodiment.
Figure 8:
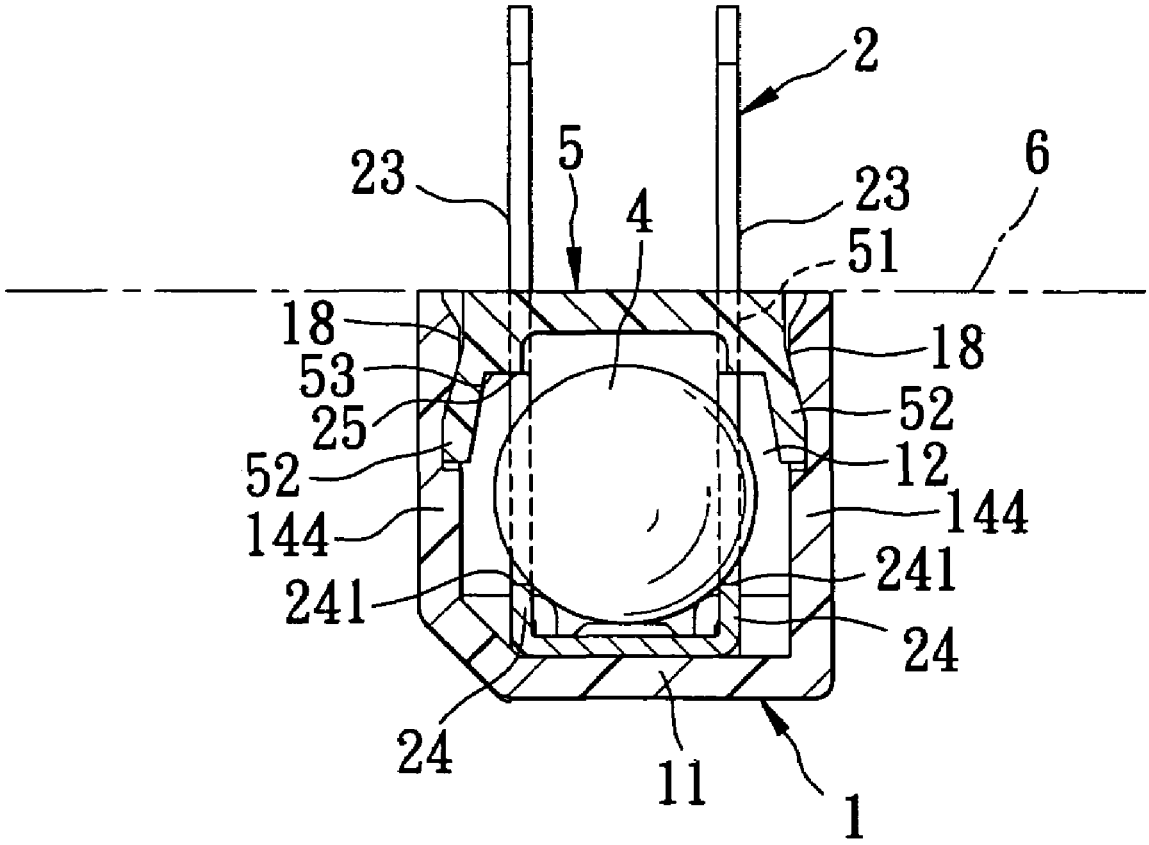
FIG. 8 is a cross-sectional view of the first preferred embodiment taken along lines 8-8 of FIG. 5.

Referring to FIGS. 4, 5 and 8, the first preferred embodiment of a jerking-initiated switch according to the present invention is shown to comprise an insulating frame 1, an electrically conductive ball 4, first and second terminal units 3,2, and a cover 5.

The frame 1 includes a base wall 11 and a surrounding wall 14. The base wall 11 has first and second lateral sides opposite to each other in a longitudinal direction (X), and front and rear sides opposite to each other in a first transverse direction (Y) transverse to the longitudinal direction (X). The surrounding wall 14 includes first and second upright walls 143 which extend respectively from the first and second lateral sides in a second transverse direction (Z) that is transverse to both the first transverse direction (Y) and the longitudinal direction (X), and front and rear upright walls 144 which extend respectively from the front and rear sides in the second direction (Z) such that an accommodation chamber 12 is confined among the base and upright walls 11,14 and defines a rolling path therein. The surrounding wall 14 extends to terminate at an opened end that defines an access opening 13. The base wall 11 has a retaining protrusion 16 disposed proximate to the second lateral side, and a plurality of spacers 17 disposed between the retaining protrusion 16 and the first lateral side. In the accommodation chamber 12, two pairs of mortises 15 are respectively formed in inner surfaces 141 of the first and second upright walls 143, and are aligned with each other in the longitudinal direction (X), and two projecting blocks 18 are respectively disposed on inner surfaces of the front and rear upright walls 144.

The ball 4 is received in the accommodation chamber 12 to be rollable along the rolling path between first and second switching positions where the jerking-initiated switch is in first and second switching states, respectively (to be described in greater detail in the succeeding paragraphs).

The first terminal unit 3 is made from an electrically conductive material, and includes a first interconnecting member 30 and front and rear first shank members 31. The first interconnecting member 30 is in the form of a plate which is secured to the first lateral side and between the spacers 17 and the first upright wall 143, and which extends in the first transverse direction (Y) to terminate at front and rear first joining ends. The front and rear first shank members 31 are integrally formed with the front and rear first joining ends, respectively, and extend in the second transverse direction (Z) to terminate at front and rear first contact terminals 33, respectively. The front and rear first contact terminals 33 extend outwardly of the frame 1 to be in electric contact with a substrate 6 (see FIG. 8). The shank members 31 are fittingly inserted into the mortises 15 in the first upright wall 143 in a tenon-and-mortise engagement.

The second terminal unit 2 is made from an electrically conductive material, and includes a second interconnecting member 20, front and rear second shank members 21, and front and rear limb members 24. The second interconnecting member 20 is in the form of a plate, and has a hole 201 formed therethrough in the second transverse direction (Z) such that the retaining protrusion 16 is inserted into the hole 201 to secure the second interconnecting member 20 to the base wall 11. The second interconnecting member 20 extends in the first transverse direction (Y) to terminate at front and rear second joining ends. The front and rear second shank members 21 are integrally formed with the front and rear second joining ends, respectively, to be spaced apart from each other in the first transverse direction (Y), and extend in the second transverse direction (Z) to respectively terminate at front and rear second contact terminals 23 that extend outwardly of the frame 1 to be in electric contact with the substrate 6 (see FIG. 8), and to respectively terminate at front and rear second joints 22 that are opposite to the front and rear second contact terminals 23, respectively. In addition, the shank members 21 are fittingly inserted into the mortises 15 in the second upright wall 143 in a tenon-and-mortise engagement.

The front and rear limb members 24 are respectively and integrally formed with the front and rear second joints 22, and extend respectively from the front and rear second joints 22 inwardly of the frame 1 and in the longitudinal direction (X) so as to cooperatively form a guideway 241 along the rolling path such that the ball 4 can slidably contact the front and rear limb members 24. The front and rear limb members 24 extend towards the front and rear first shank members 31, respectively, to terminate at front and rear threshold regions 243, respectively. The front and rear threshold regions 243 are spaced apart from the front and rear first shank members 31, respectively, and correspond to the first switching position. The front and rear limb members 24 respectively have front and rear idle regions 242 which are configured to correspond to the second switching position. Moreover, the second interconnecting member 20 further extends in the longitudinal direction (X) to connect the front and rear limb members 24.

The cover 5 is disposed to close the access opening 13, and has four through holes 51 formed therethrough in the second transverse direction (Z) such that the front and rear first and second contact terminals 33,23 extend outwardly of the frame through the through holes 51, respectively.

Each of the front and rear first shank members 31 has a first shoulder portion 34 which is disposed between a respective one of the front and rear first joining ends of the first interconnecting member 30 and a respective one of the front and rear first contact terminals 33. Each of the front and rear second shank members 21 has a second shoulder portion 25 which is disposed between a respective one of the front and rear second joints 22 and a respective one of the front and rear second contact terminals 23 such that an inner surface 53 of the cover 5 is brought to abut against the first and second shoulder portions 34,25 when the cover 5 closes the access opening 13. The cover 5 has two projecting blocks 52 which are disposed to interengage the projecting blocks 18 so as to firmly secure the cover 5 to the surrounding wall 14, as shown in FIG. 8.

Figure 6:
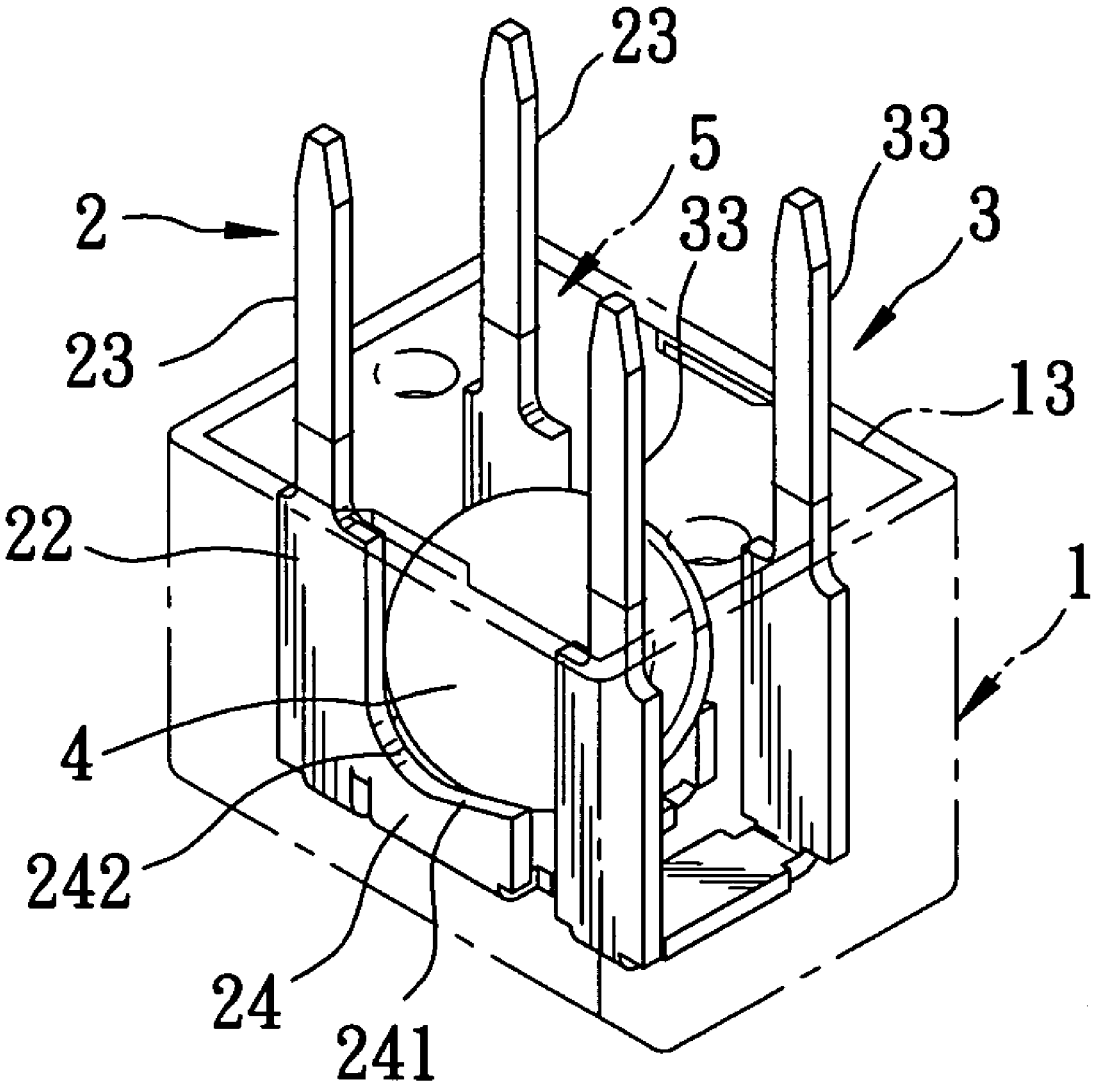
FIG. 6 is a schematic perspective view of the first preferred embodiment in an upright state.
Figure 7:
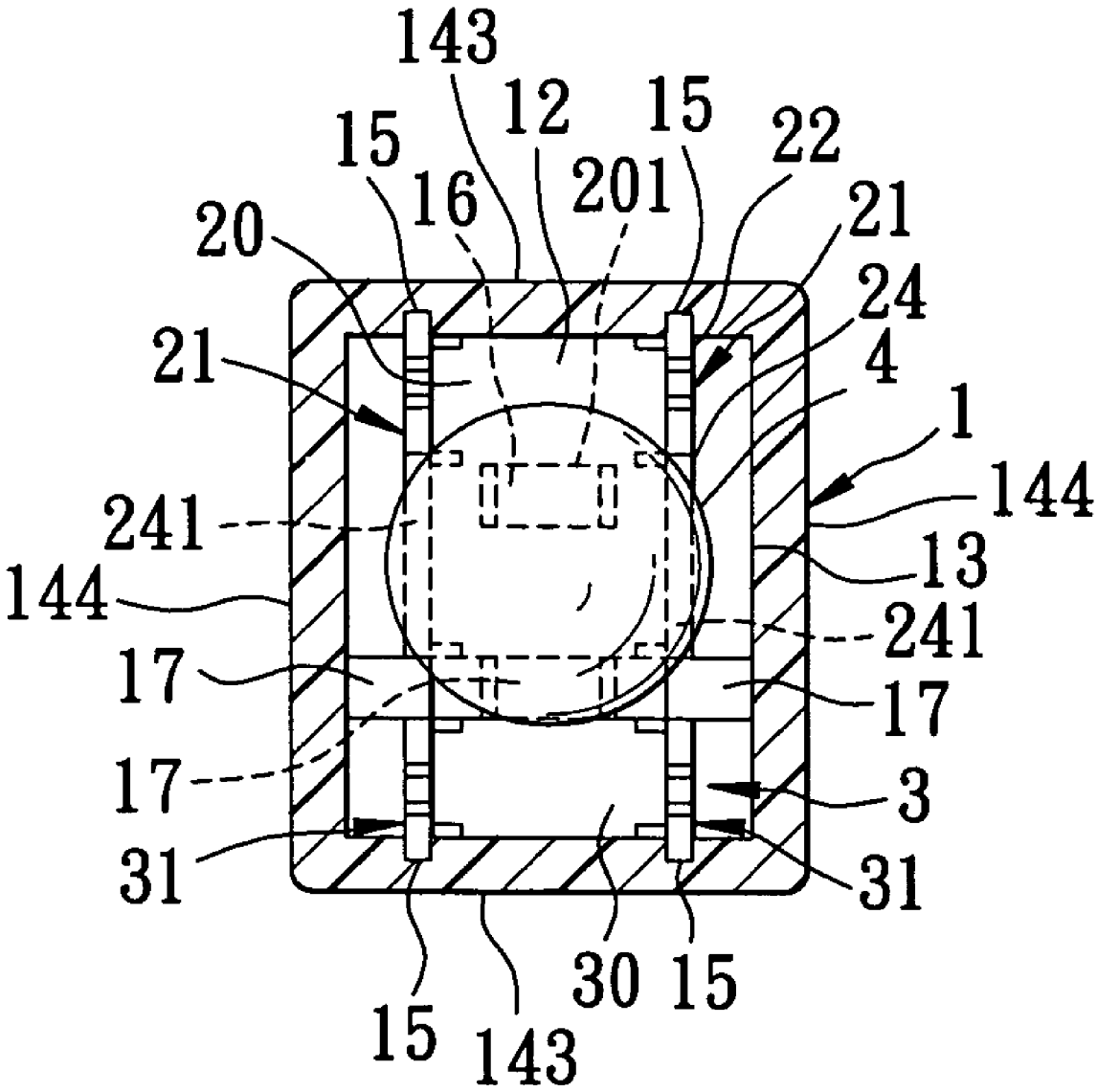
FIG. 7 is a cross-sectional view of the first preferred embodiment.
Figure 9:
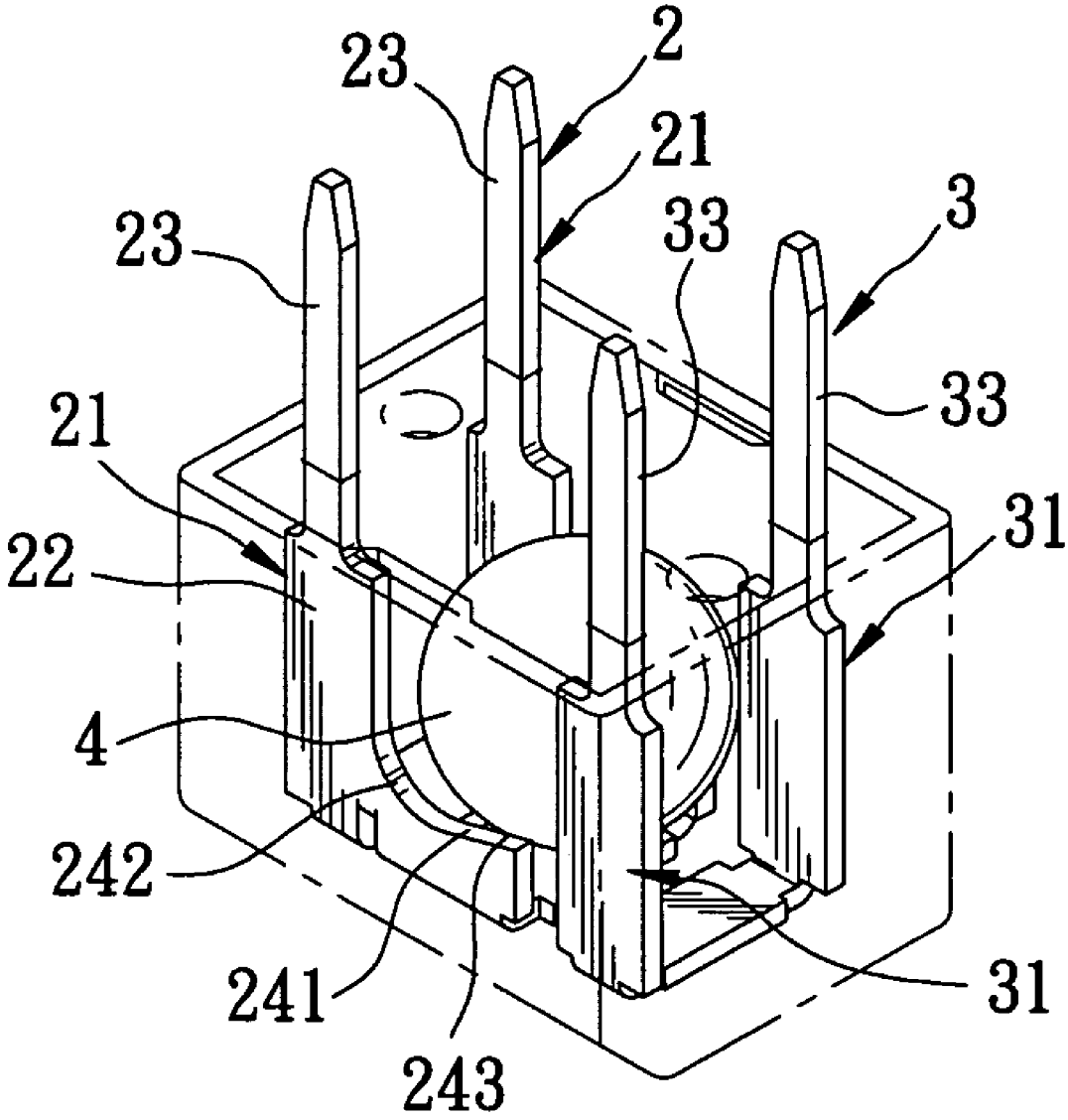
FIG. 9 is a view similar to FIG. 6 but showing the first preferred embodiment in a jerked state.
Figure 10:
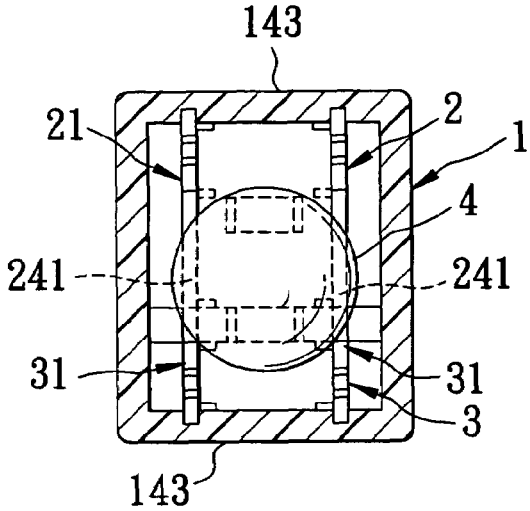
FIG. 10 is a view similar to FIG. 7 but showing the first preferred embodiment in a jerked state.
Figure 11:
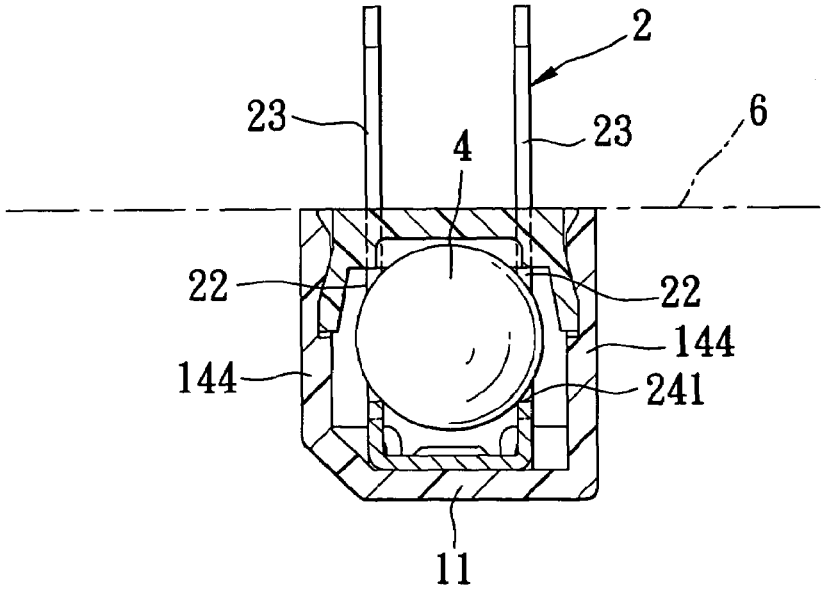
FIG. 11 is a view similar to FIG. 8 but showing the first preferred embodiment in a jerked state.

In this embodiment, each of the guideways 241 is configured to ascend from a respective one of the front and rear idle regions 242 to a respective one of the front and rear threshold regions 243 in the longitudinal direction (X). Therefore, as shown in FIGS. 6 to 8, when the switch of this embodiment is mounted uprightly on an underside of the substrate 6, the ball 4 rests on the idle regions 242 to place the switch in the second switching state, where the first contact terminals 33 are not electrically connected to the second contact terminals 23. As shown in FIGS. 9 to 11, a jerking action will cause the ball 4 to displace from the idle regions 242 to the threshold regions 243 and to come into contact with the front and rear first shank members 31 so as to place the switch in the first switching state, where the first contact terminals 33 are electrically connected to the second contact terminals 23 through the ball 4.

As illustrated, as compared with the conventional switch 100, the first and second terminal units 3, 2 in this invention are fitted into the frame 1 individually, and are retained therein by virtue of the engagement between the frame 1 and the cover 5. Thus, the problem associated with alignment of the terminals 103 in the housing 101 of the conventional switch 100 can be overcome, and the terminal units 3,2 can be retained on the frame 1 steadily and firmly. In addition, since the limb members 24 are of a plate shape, the area of contact between the limb members 24 and the ball 4 is increased to result in enhanced electric contact, and improved sensitivity.

Figure 18:
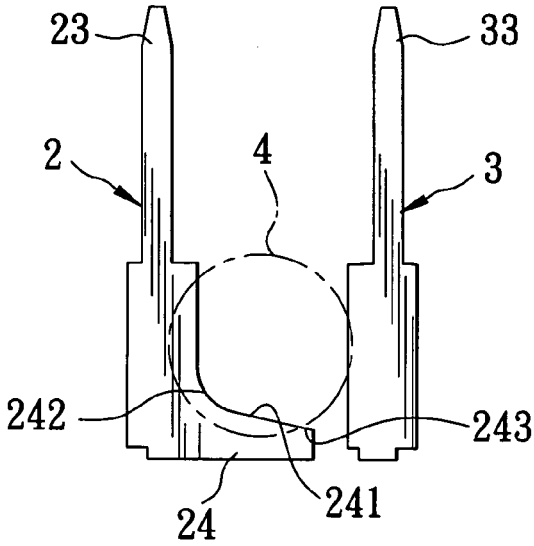
FIGS. 18 to 21 are schematic views showing the modifications of limb members of the above-mentioned embodiments.
Figure 19:
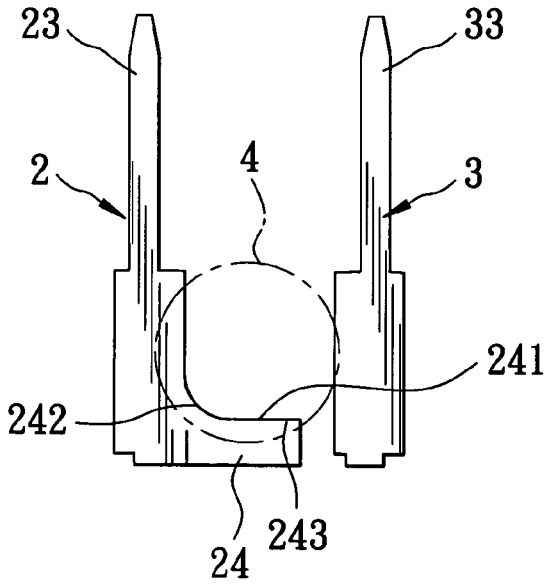
Figure 20:
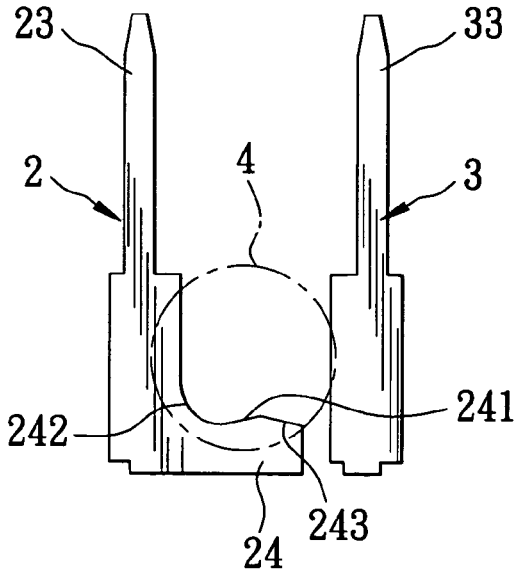
Figure 21:
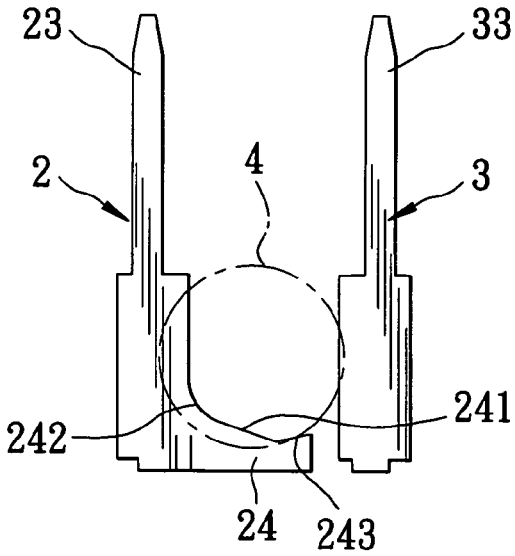

Moreover, the configuration of the guideways 241 can be modified as required. For example, instead of the ascending configuration of the guideways 241 as shown in FIG. 4, the guideways 241 may be configured to descend from a respective one of the front and rear idle regions 242 to a respective one of the front and rear threshold regions 243 in the longitudinal direction (X), as shown in FIG. 18. Therefore, the ball 4 is rested on the threshold regions 243 to place the switch in the first switching state, where an electric connection between the first and second contact terminals 33,23 is established through the ball 4. On the other hand, a jerking action will cause the ball 4 to displace from the threshold regions 243 to the idle regions 242 so as to place the switch in the second switching state, where the electric connection between the first and second contact terminals 33,23 is cut off. Alternatively, the guideways 241 may be configured to have parallel paths in the longitudinal direction (X), as shown in FIG. 19. Alternatively, each of the guideways 241 may be configured to have an ascending segment extending from the respective idle region 242, and a descending segment extending from the ascending segment to the respective threshold region 243, as shown in FIG. 20. Alternatively, each of the guideways 241 may be configured to have a descending segment extending from the respective idle region 242, and an ascending segment extending from the descending segment to the respective threshold region 243, as shown in FIG. 21.

Figure 12:
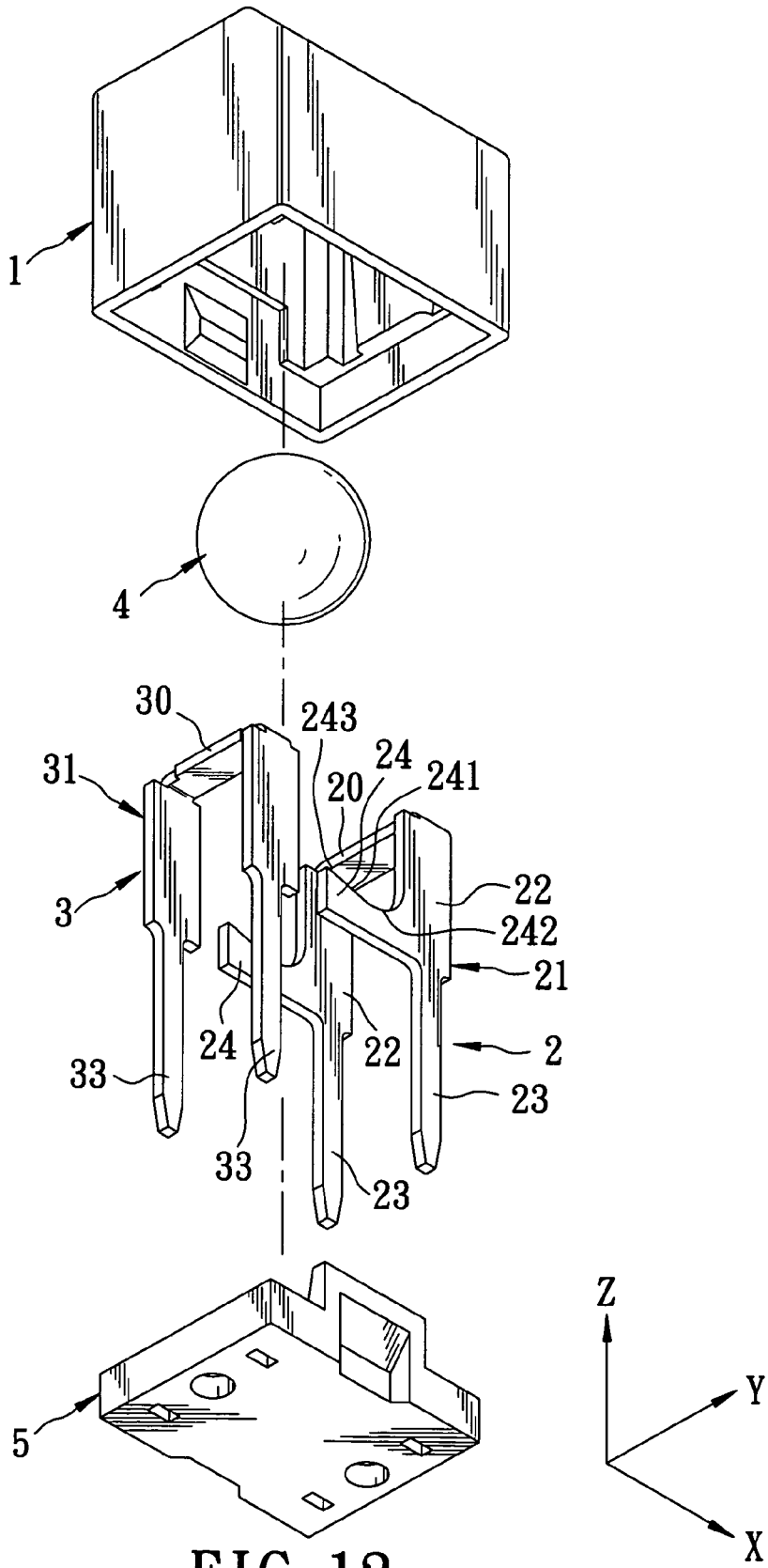
FIG. 12 is an exploded perspective view of the second preferred embodiment of a jerking-initiated switch according to this invention.
Figure 13:
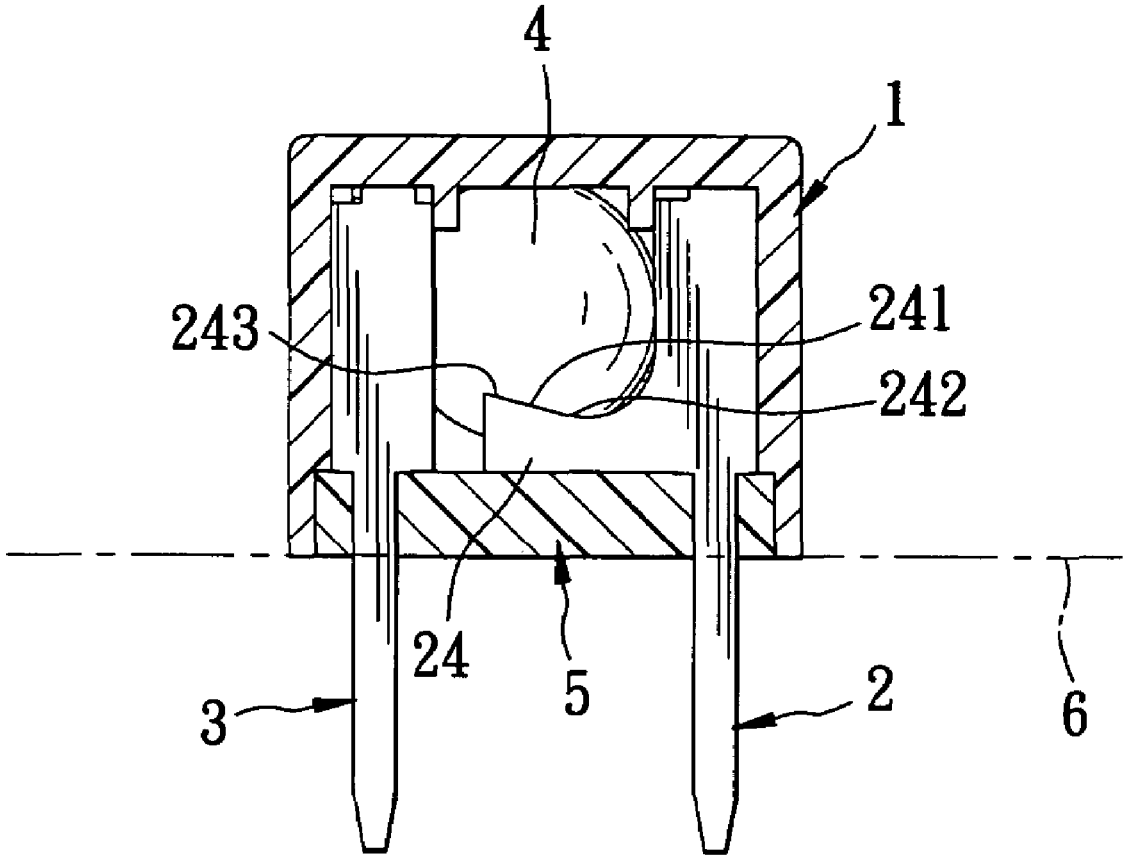
FIG. 13 is a sectional view of the second preferred embodiment.

Referring to FIGS. 12 and 13, the second preferred embodiment of a jerking-initiated switch according to this invention is shown to be similar to the first embodiment in construction. In the second embodiment, the switch is adapted to be mounted on a substrate 6. That is, the cover 5 is attached to the substrate 6. In addition, the front and rear limb members 24 are spaced apart from the second interconnecting member 20 in the second transverse direction (Z).

Figure 14:
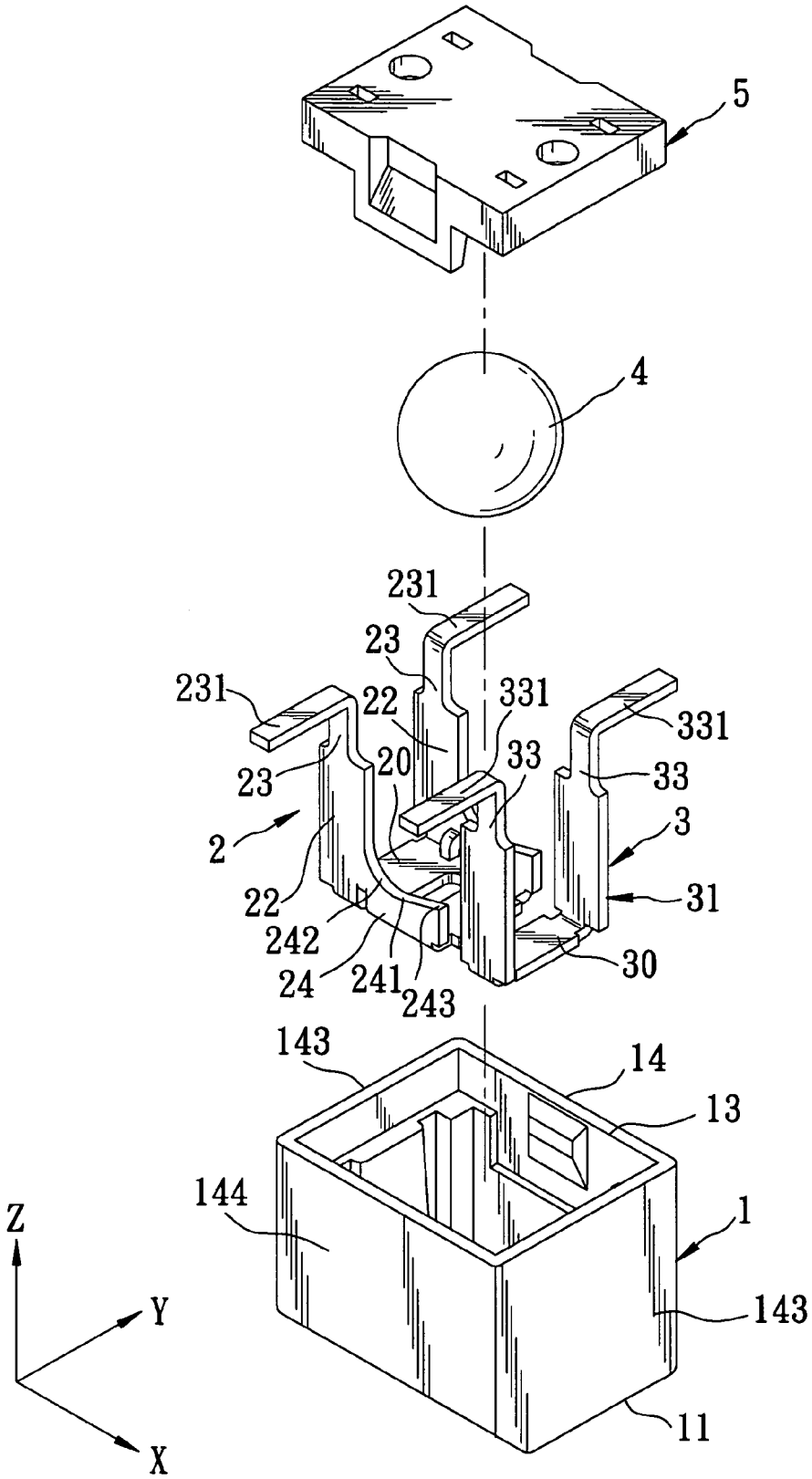
FIG. 14 is an exploded perspective view of the third preferred embodiment of a jerking-initiated switch according to this invention.
Figure 15:
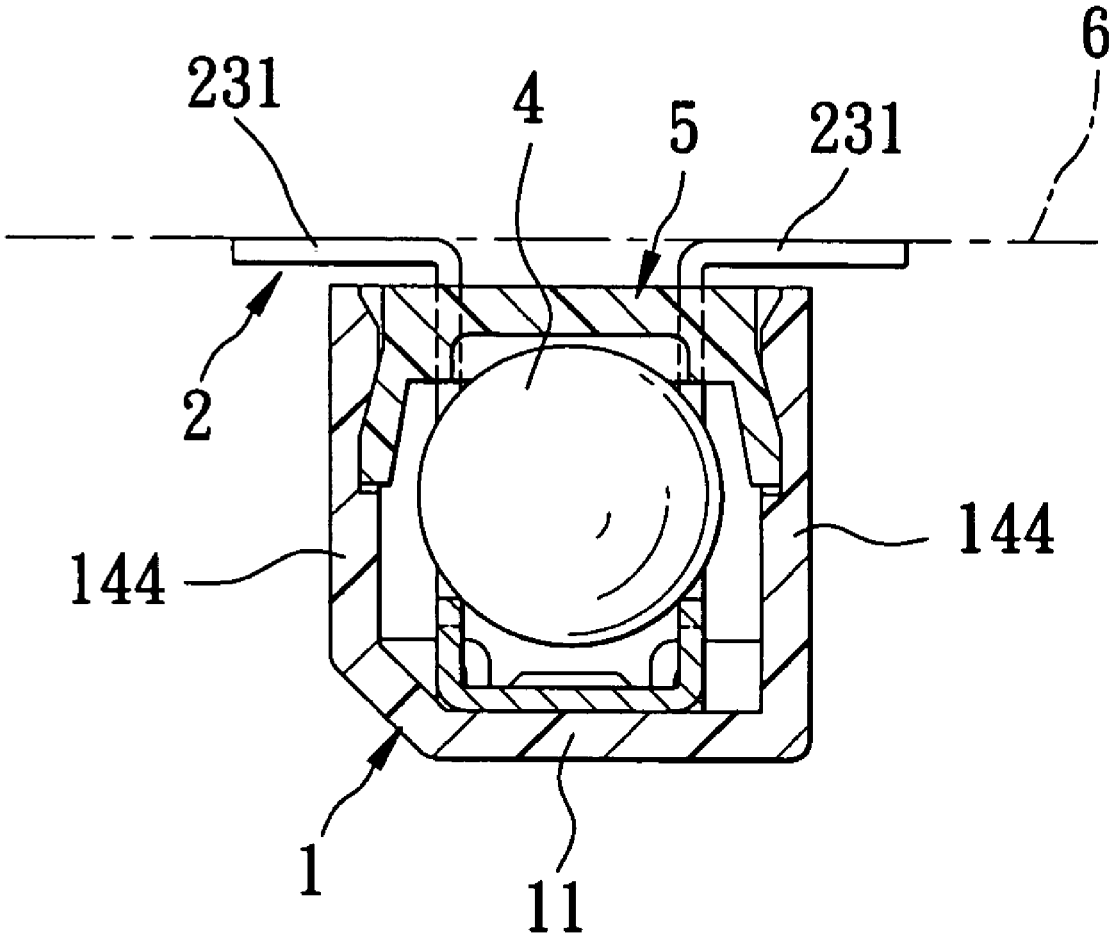
FIG. 15 is a sectional view of the third preferred embodiment.

Referring to FIGS. 14 and 15, the third preferred embodiment of a jerking-initiated switch according to this invention is shown to be similar to the first embodiment in construction. In the third embodiment, each of the front and rear first and second contact terminals 33,23 has a contact end 331, 231 which is bent to extend in the first transverse direction (Y) and which has a major surface that is adapted to be attached to the substrate 6 using a conventional SMT (surface mount technology) process.

Figure 16:
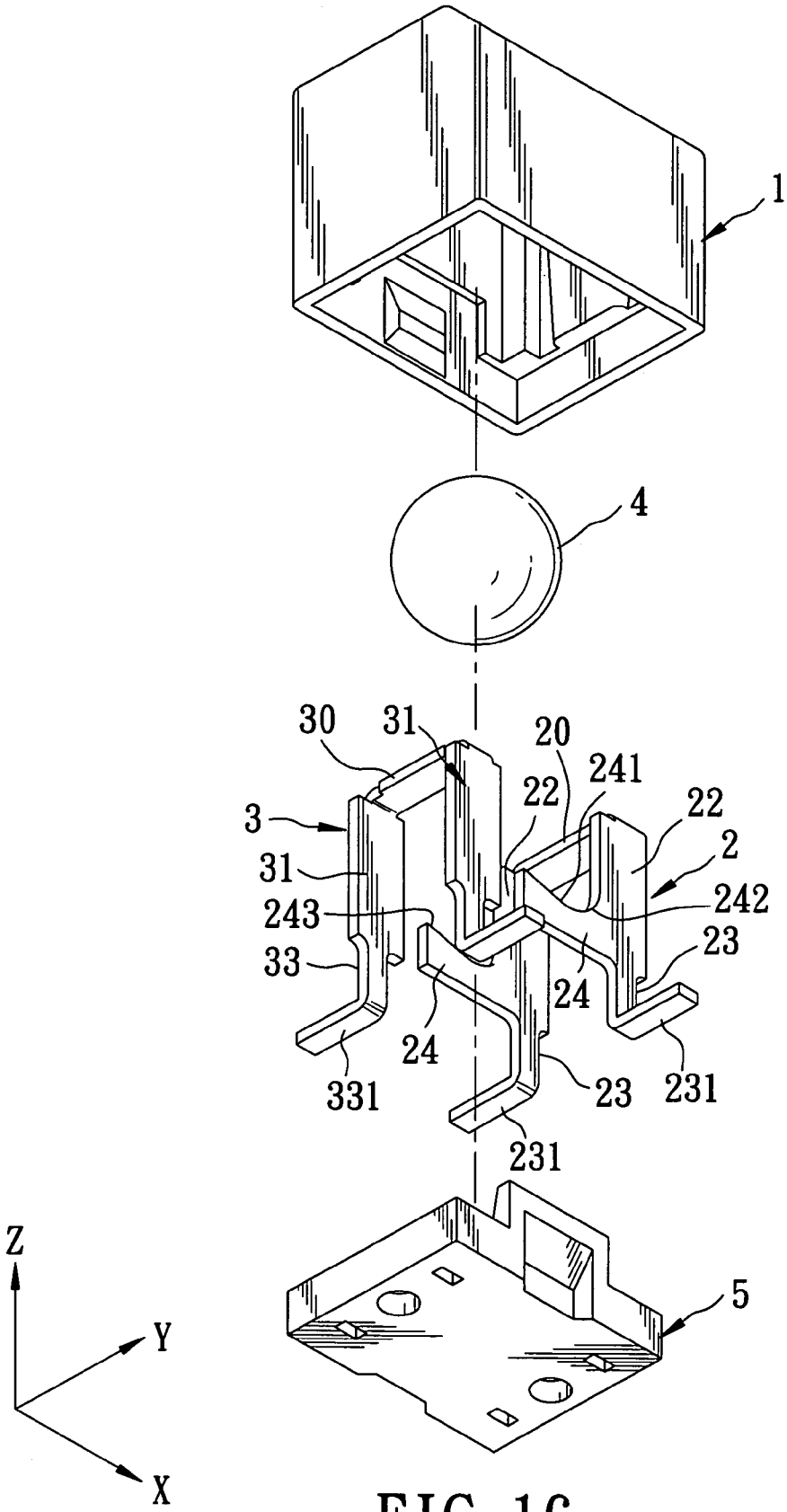
FIG. 16 is an exploded perspective view of the fourth preferred embodiment of a jerking-initiated switch according to this invention.
Figure 17:
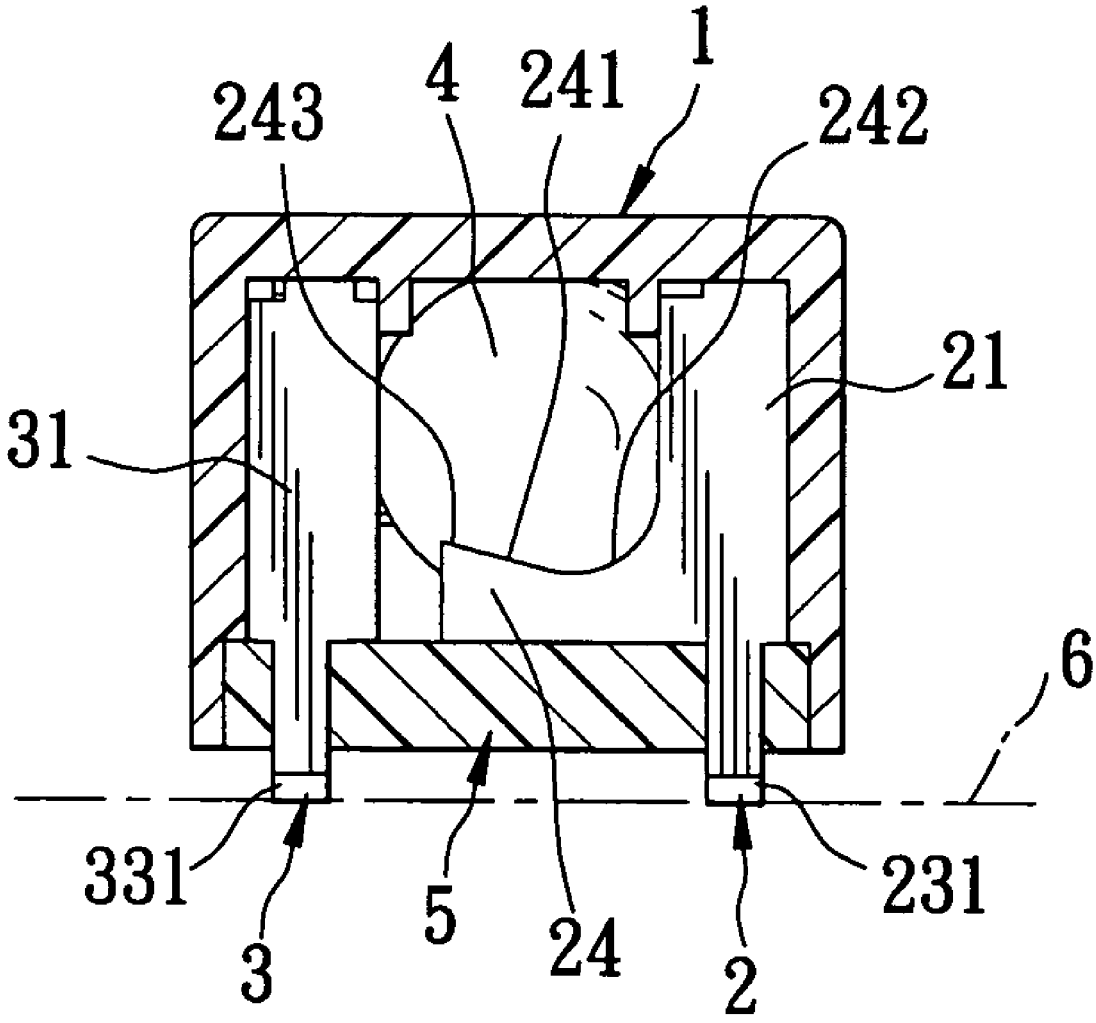
FIG. 17 is a sectional view of the fourth preferred embodiment.

Referring to FIGS. 16 and 17, the fourth preferred embodiment of a jerking-initiated switch according to this invention is shown to be similar to the second embodiment in construction so as to be adapted for mounting on a substrate 6. In the fourth embodiment, each of the front and rear first and second contact terminals 33,23 has a contact end 331,231 which is bent to extend in the first transverse direction (Y) and which has a major surface that is adapted to be attached to the substrate 6 using a conventional SMT process.

It is noted that in any one of the above-mentioned second to fourth embodiments, the guideways 241 can also be modified to have a configuration such as that shown in any one of FIGS. 18 to 21 according to the requirements of the switch in use.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A jerking-initiated switch adapted to be mounted on and to be in electric contact with a substrate, said jerking-initiated switch comprising:

an insulating frame which includes a base wall that has first and second lateral sides opposite to each other in a longitudinal direction, and front and rear sides opposite to each other in a first direction transverse to the longitudinal direction, and first and second upright walls extending respectively from said first and second lateral sides in a second direction transverse to both the first transverse direction and the longitudinal direction to define therebetween a rolling path;

an electrically conductive ball disposed to be rollable along said rolling path between first and second switching positions where said switch is in first and second switching states, respectively;

a first interconnecting member which is secured to said first lateral side, and which extends in the first transverse direction to terminate at front and rear first joining ends;

front and rear first shank members which are made from an electrically conductive material, which are respectively connected to said front and rear first joining ends, and which extend in the second transverse direction to terminate at front and rear first contact terminals, respectively, said front and rear first contact terminals extending outwardly of said frame to be in electric contact with the substrate;

front and rear second shank members which are made from an electrically conductive material, and which are respectively secured to said second lateral side, said front and rear second shank members being spaced apart from each other in the first transverse direction, and being disposed to extend in the second transverse direction to respectively terminate at front and rear second contact terminals that extend outwardly of said frame to be in electric contact with the substrate, and at front and rear second joints that are opposite to said front and rear second contact terminals, respectively;

front and rear limb members which are respectively and integrally formed with said front and rear second joints, which respectively extend from said front and rear second joints in the longitudinal direction to cooperatively form a guideway along said rolling path such that said ball can slidably contact said front and rear limb members, and which extend towards said front and rear first shank members, respectively, to terminate at front and rear threshold regions, respectively, said front and rear threshold regions being spaced apart from said front and rear first shank members, respectively, and corresponding to the first switching position, said front and rear limb members respectively having front and rear idle regions which are configured to correspond to the second switching position such that once said ball is caused to displace from one of said idle and threshold regions to the other of said idle and threshold regions in response to a jerking action, said switch is placed in one of the first and second switching states.

2. The jerking-initiated switch of claim 1, further comprising a second interconnecting member which is secured to said second lateral side, and which extends in the first transverse direction to terminate at front and rear second joining ends, said first and rear second joining ends being respectively connected to said front and rear second joints.

3. The jerking-initiated switch of claim 2, wherein said second interconnecting member is in form of a plate, extends in the longitudinal direction to connect said front and rear limb members, and has a hole formed therethrough in the second transverse direction, said base wall having a retaining protrusion which is inserted into said hole to secure said second interconnecting member to the base wall.

4. The jerking-initiated switch of claim 2, wherein said front and rear limb members are spaced apart from said second interconnecting member in the second transverse direction.

5. The jerking-initiated switch of claim 2, wherein said first and second upright walls extend from said base wall to terminate at an opened end that defines an access opening, said jerking-initiated switch further comprising a cover which is disposed to close said access opening and which has four through holes formed therethrough in the second transverse direction such that said front and rear first and second contact terminals extend outwardly of said frame through said through holes, respectively.

6. The jerking-initiated switch of claim 5, wherein each of said front and rear first shank members has a first shoulder portion which is disposed between a respective one of said front and rear first joining ends and a respective one of said front and rear first contact terminals, each of said front and rear second shank members having a second shoulder portion which is disposed between a respective one of said front and rear second joints and a respective one of said front and rear second contact terminals such that said cover is brought to abut against said first and second shoulder portions when said cover closes said access opening.

7. The jerking-initiated switch of claim 1, wherein said first interconnecting member is in form of a plate, and is integrally formed with said front and rear first shank members.

8. The jerking-initiated switch of claim 1, wherein said front and rear first shank members are fitted into said first upright wall in a tenon-and-mortise engagement, and said front and rear second shank members are fitted into said second upright wall in a tenon-and-mortise engagement.

9. The jerking-initiated switch of claim 1, wherein said guideway is configured to ascend from a respective one of said front and rear idle regions to a respective one of said front and rear threshold regions in the longitudinal direction such that said ball is rested on said idle regions to place said switch in the second switching state, where said first contact terminals are not electrically connected to said second contact terminals, and such that said ball is caused to displace from said idle regions to said threshold regions in response to the jerking action so as to place said switch in the first switching state, where said first contact terminals are electrically connected to said second contact terminals through said ball.

10. The jerking-initiated switch of claim 1, wherein said guideway is configured to descend from a respective one of said front and rear idle regions to a respective one of said front and rear threshold regions in the longitudinal direction such that said ball is rested on said threshold regions to place said switch in the first switching state, where an electrical connection between said first and second contact terminals is established through said ball, and such that said ball is caused to displace from said threshold regions to said idle regions in response to the jerking action so as to place said switch in the second switching state, where the electrical connection between said first and second contact terminals is cut off.

* * * * *